United States Patent [19]

Yamamoto et al.

[11] Patent Number: 5,018,335

[45] Date of Patent: May 28, 1991

[54] CAPSULE CHARGING APPARATUS

[75] Inventors: Taizo Yamamoto, Osaka; Hirokazu Konishi, Sakurai, both of Japan

[73] Assignee: Nippon Elanco Kabushiki Kaisha, Osaka, Japan

[21] Appl. No.: 455,096

[22] Filed: Dec. 22, 1989

[30] Foreign Application Priority Data

Dec. 28, 1988 [JP] Japan ..... 63-334002

[51] Int. Cl.[5] ..... A61J 5/00; B65B 43/40

[52] U.S. Cl. ..... 53/281; 53/478; 53/900

[58] Field of Search ..... 53/281, 282, 283, 478, 53/467, 468, 471, 454, 560, 900

[56] References Cited

U.S. PATENT DOCUMENTS

| | | | |
|---|---|---|---|
| 3,501,894 | 3/1970 | Hayashi et al. | 53/281 |
| 3,978,640 | 9/1976 | Crossley et al. | 53/900 X |
| 4,091,600 | 5/1978 | Itoh | 53/900 X |
| 4,163,354 | 8/1979 | Austin | 53/436 |
| 4,353,456 | 10/1982 | Yamamoto | 198/397 |
| 4,581,875 | 4/1986 | MacLaughlin et al. | 53/478 X |
| 4,677,812 | 7/1987 | Tayebi | 53/478 X |
| 4,731,979 | 3/1988 | Yamamoto et al. | 53/529 |
| 4,861,415 | 8/1989 | Gamberini | 53/900 X |

FOREIGN PATENT DOCUMENTS

| | | |
|---|---|---|
| 0194505 | 9/1986 | European Pat. Off. . |
| 1545686 | 11/1968 | France . |
| 61-213050 | 3/1985 | Japan . |

OTHER PUBLICATIONS

European Search Report for EPC Application No. 89/313633.3, dated Mar. 14, 1990.

*Primary Examiner*—James F. Coan
*Attorney, Agent, or Firm*—Irell & Manella

[57] ABSTRACT

A capsule charging apparatus for charging a hard gelatin capsule with a filling of powder, granule, or liquid continuously at every constant amount, in which operation processes such as receiving, holding, separating, charging with the filling, recoupling, and ejecting of the capsule are performed in order during one rotation of a turntable at plural positions defined by a predetermined rotation angle by which the turntable intermittently rotates, the turntable comprising a pair of rotary members disposed opposite to each other with a fixed space therebetween in the vertical direction of a vertical shaft, and between the upper and lower rotary members being interposed capsule guide members for connecting cap containing pockets with corresponding body containing pockets of the rotary members in order to separate the capsule into the cap and body and recouple them.

3 Claims, 12 Drawing Sheets

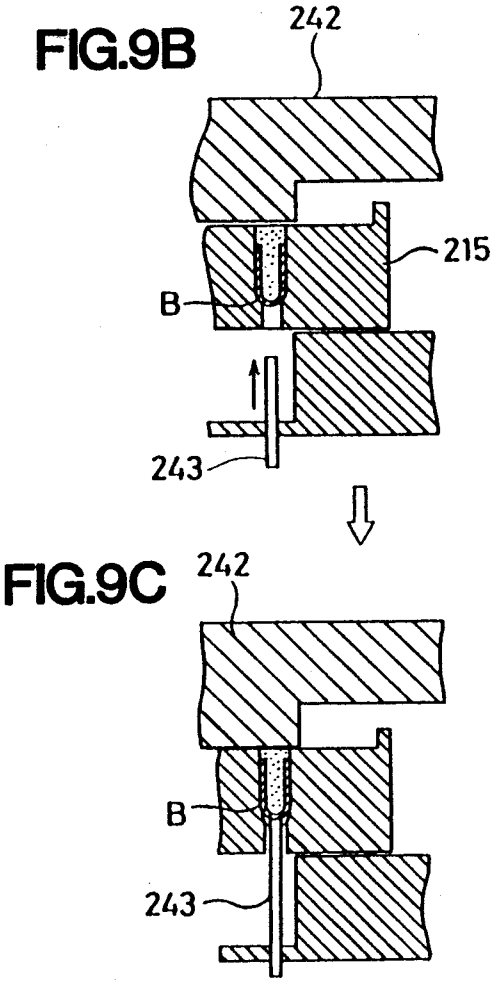
FIG.9B
FIG.9C
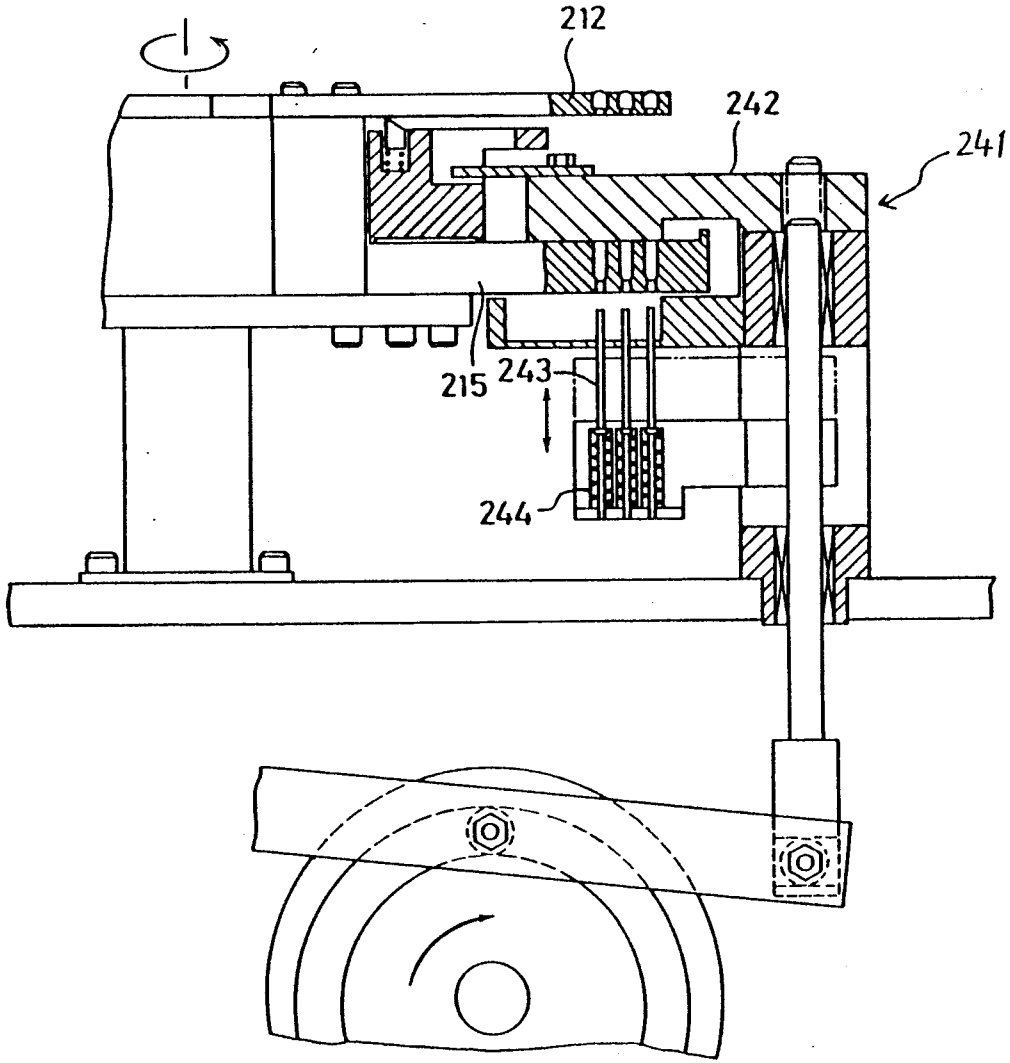
FIG.9A

CAPSULE CHARGING APPARATUS

BACKGROUND OF THE INVENTION

1. Field of the invention

The present invention relates to a charging apparatus for charging a hard gelatin capsule (hereinafter, merely called "the capsule") with a certain form of filling, and more particularly to a charging apparatus for charging the capsule with pharmaceutics or foodstuffs in powder, granule or liquid form, continuously in constant amounts.

2. Description of the prior art

As well-known, capsules charged with medicine as well as tablets and pellets are at present generally used as oral medicine in the field of medicament.

Such a capsule charged with medicine is obtained by charging the pharmaceutics in powder, granule or liquid form, at a predetermined amount into a small vessel made of gelatin, that is, an empty capsule, comprising a tubular body portion which is usually open at one end and domically closed at the other end and a cap portion which is the same in shape as the body portion and of a slightly larger inner diameter than an outer diameter of the body portion, the body and cap being coaxially coupled with each other (i.e., the open end of the body is inserted into the open end of the cap). The pharmaceutics are charged into the capsule at high speed and automatically in continuation by use of an apparatus usually called a capsule charging apparatus.

The capsule charging apparatus has hitherto been put in practical use in various models. Furthermore, various improvements have been proposed aiming at high speed charging (improved processing ability), improvement in charging accuracy and/or miniaturization of apparatus, which are disclosed in, for example, the Japanese Patent Publication No. 49-38813 and Japanese Laid-Open Patent Publication No. 61-213050. The well-known capsule charging apparatus of these prior applications are so constructed that in order to ensure a space for supplying filling onto the bodies of capsules in the charging process, separated caps are grouped into a plurality of members and each group is temporarily moved upwards from the bodies, or while keeping the caps as they are, the bodies are projected in the radial direction of a rotary member for containing them and temporarily separated from the caps.

Accordingly, the conventional capsule charging apparatus nearly always attains the object of charging the filling at high speed, but it is inevitable to make the apparatus large-sized as a whole, and it is largely inconvenient for over all maintenance to adjust the apparatus when the applied capsules are changed in the size.

SUMMARY OF THE INVENTION

The capsule charging apparatus of this invention, which overcomes the above-discussed and numerous other disadvantages and deficiencies of the prior art, is a capsule charging apparatus for charging a hard gelatin capsule with a filling of powder, granule, or liquid continuously in constant amounts, wherein the capsule having a cap and a body coupled together is received and held in an upright posture at one of the positions in which a turntable intermittently rotatable through every predetermined rotation angle around a vertical shaft pauses, and operation processes such as separation of said cap from said body of said capsule, charging of said filling into said body, coupling of said cap with said body, and ejection of said charged capsule are performed in order during one rotation of said turntable at plural positions including said position which are defined by said rotation angle of said turntable, said capsule charging apparatus being characterized in that said turntable comprises a pair of rotary members disposed opposite to each other with a predetermined space therebetween in the vertical direction of said vertical shaft of said turntable, and between said upper and lower rotary members are interposed capsule guide members capable of connecting cap containing pockets with corresponding body containing pockets of said rotary members for separating of said capsule into said cap and body and recoupling of them.

In a preferred embodiment, the capsule guide member for separating said capsule comprises tubular members inserted one end thereof movably in the vertical direction into pocket bores with large diameter allowing said capsule to pass therethrough, and said capsule guide member for coupling said capsule comprises tubular members provided movably in the vertical direction allowing said capsule to pass therethrough.

In a preferred embodiment, the capsule body is charged by natural fall of said filling.

In a preferred embodiment, the capsules are substantially simultaneously processed in groups consisting of a plural number of capsules in a series of said operation processes.

Thus, the invention described herein makes possible the objective of providing a capsule charging apparatus which is simplified in mechanism, designed to be small-sized as a whole, and superior in work efficiency and productivity.

BRIEF DESCRIPTION OF THE DRAWINGS

This invention may be better understood and its numerous objects and advantages will become apparent to those skilled in the art by reference to the accompanying drawings as follows:

FIGS. 9A, 9B, and 9C are sectional side views showing a compression mechanism for the filling of the capsule charging apparatus of the present invention.

DESCRIPTION OF THE PREFERRED EMBODIMENTS

Figure 1:
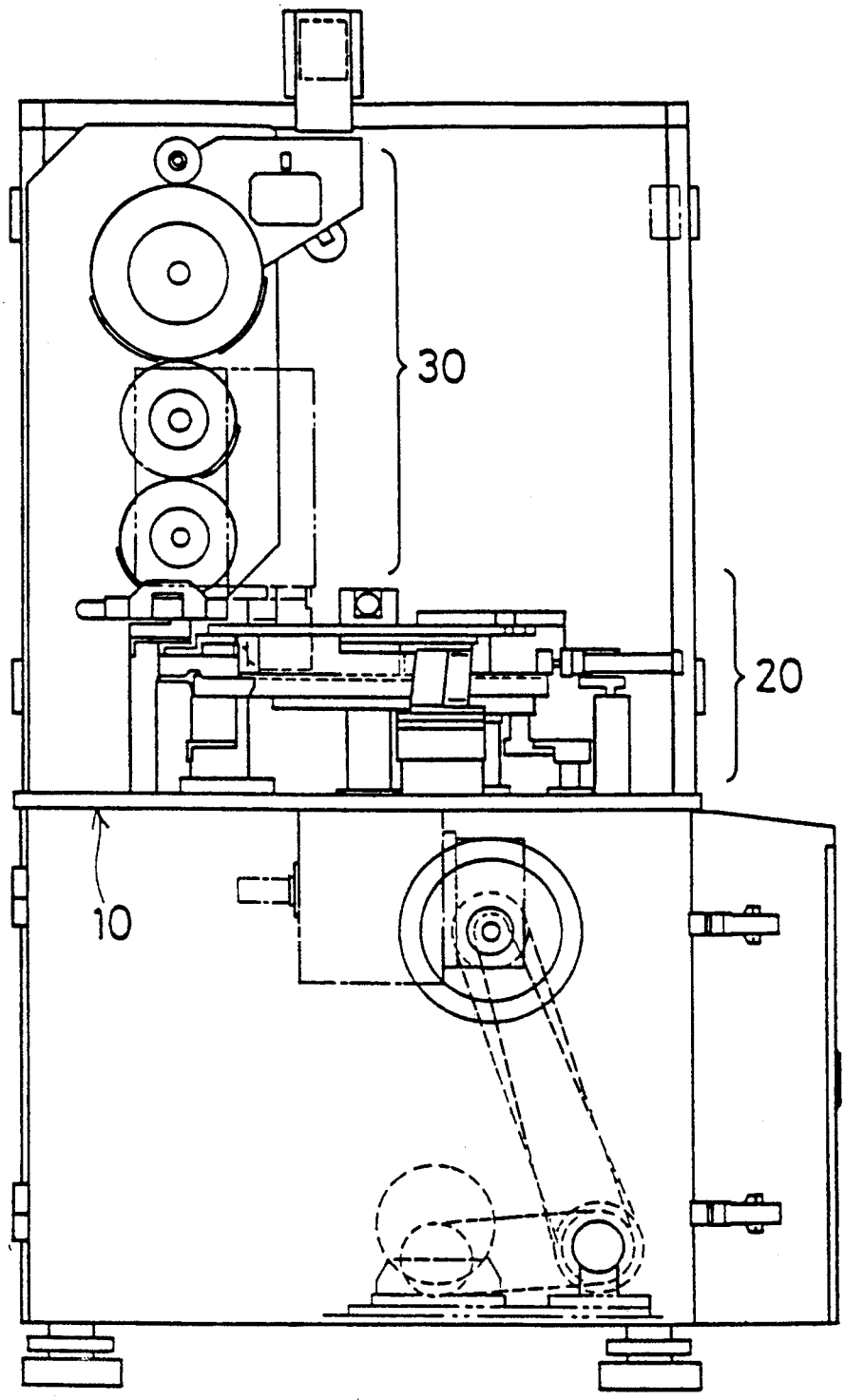
FIG. 1 is a schematic side view of a capsule charging apparatus of the present invention.
Figure 2:
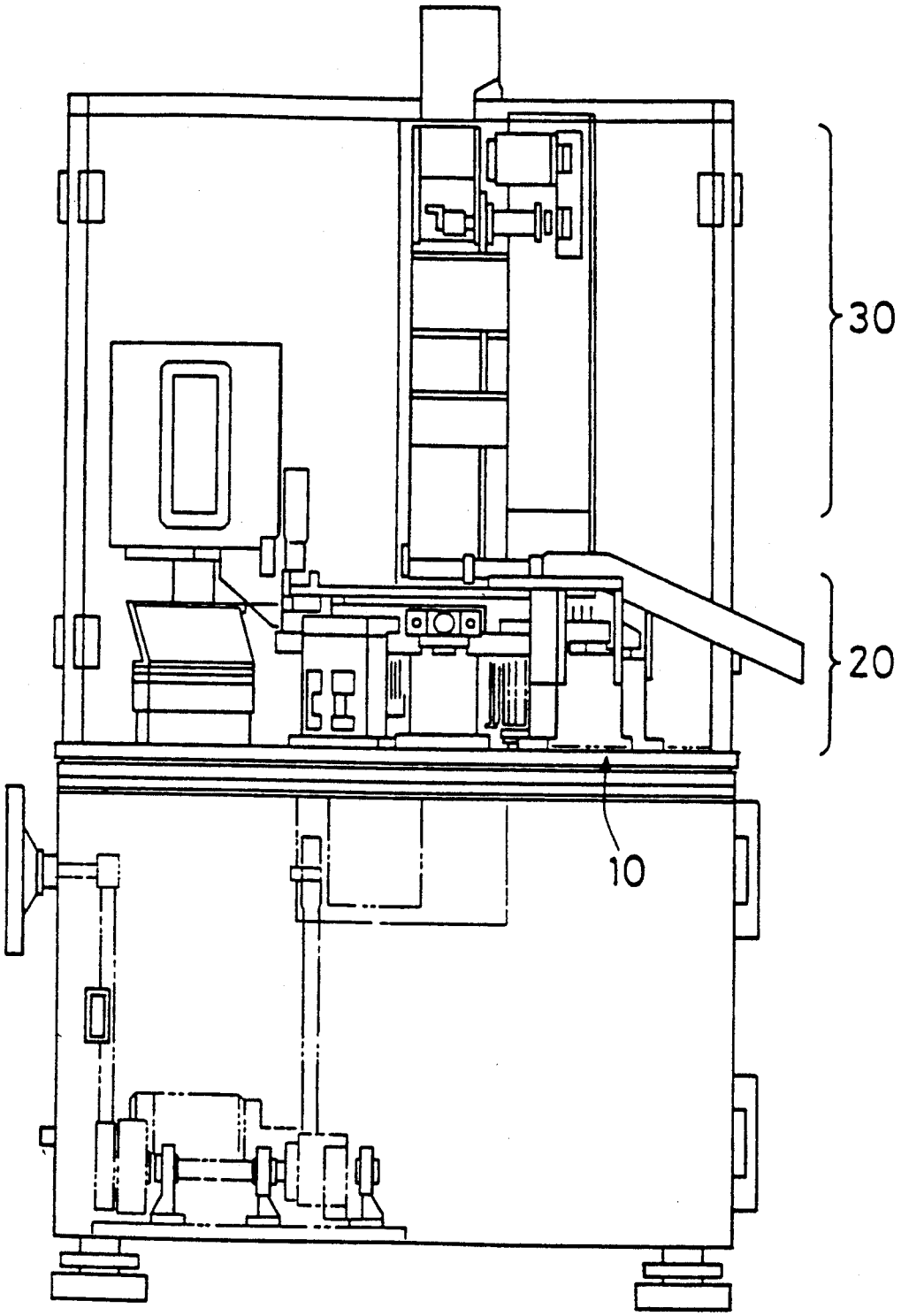
FIG. 2 is a front view of the capsule charging apparatus of the present invention.

Next, an embodiment of the invention will be detailed in accordance with the accompanying drawings.

The capsule charging apparatus of the present invention, as shown in FIGS. 1 through 4, is provided on a stand 10 with a charging mechanism 20 as a main part, a capsule direction regulating mechanism 30, a charged-capsule ejection mechanism 40, and a control panel 50 for controlling these mechanisms. The charging mechanism 20 has a filling supply mechanism 22, a vibration applying mechanism 23 for the filling, a filling quantifying mechanism 24, a capsule coupling mechanism 25, a cleaning mechanism 26 or the like, which are disposed around a turntable 21 which intermittently rotates in the direction shown by an arrow and pauses at every predetermined rotation angle around the vertical shaft while transferring capsules. These mechanisms are relevant to each other as well as to other mechanisms and members (not shown) and operate with a timing corresponding to intermittent rotation of the turntable 21 as a whole, which will be detailed below.

Figure 5:
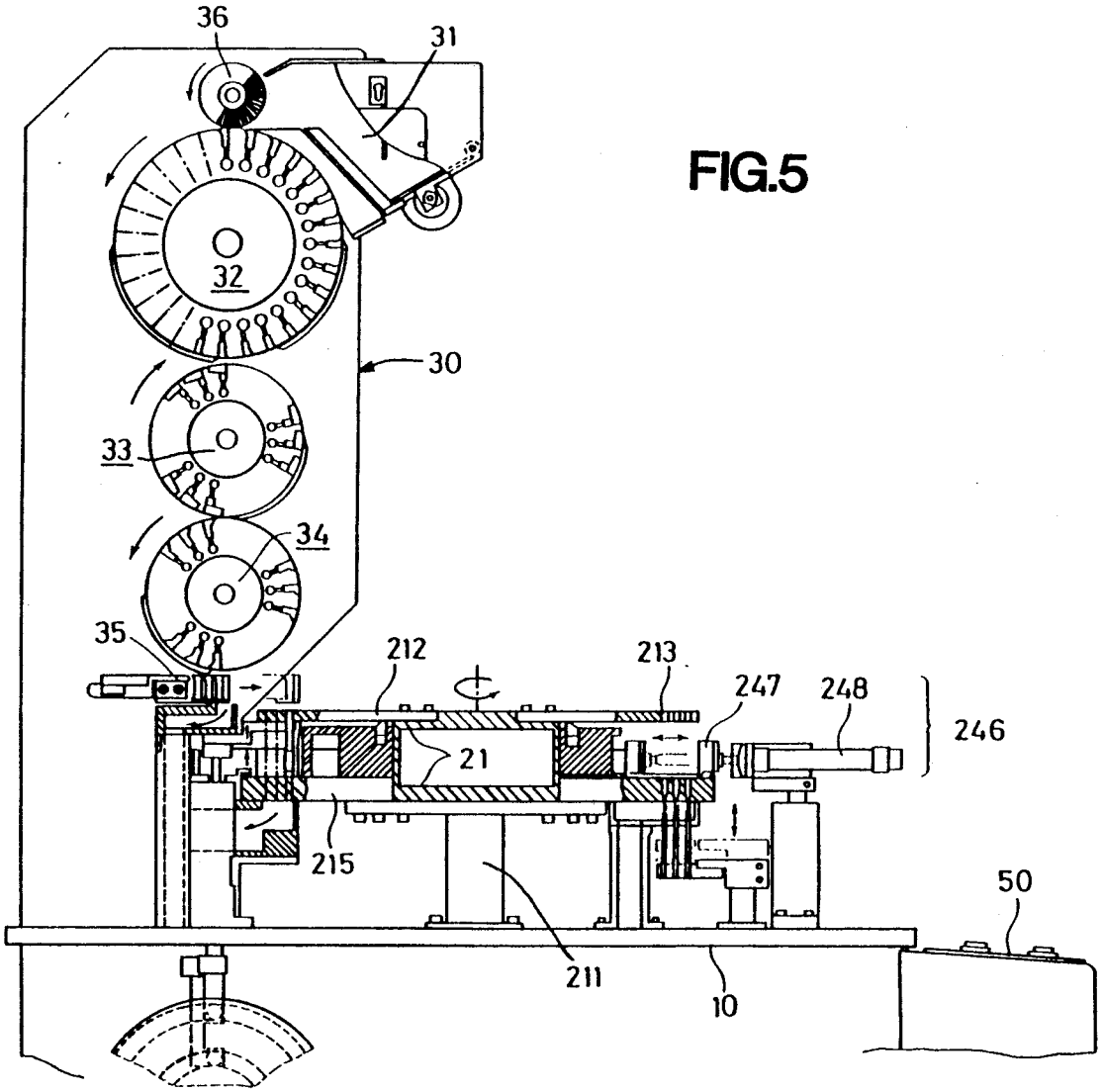
FIG. 5 is a side view illustrating the relation between a capsule direction regulating mechanism and a charging mechanism of the capsule charging apparatus of the present invention.

The capsule direction regulating mechanism 30, as shown in FIG. 5, comprises a supply drum 32 contacting at a part of the circumferential surface thereof with a lower supply port of a hopper 31, a regulating roller 33 provided below the supply drum 32 to face the lower portion of the supply drum 32, a contrarotating drum 34 provided below the regulating roller 33 to face the lower portion of the regulating roller 33, and a capsule transporting mechanism 35 provided below the contrarotating drum 34 to face the lower portion of the contrarotating drum 34. A large number of empty capsules which are contained in the hopper 31 at random and in a state where caps and bodies of capsules are temporarily coupled are arranged with bodies facing downward, delivered to the capsule transporting mechanism 35, and then transported in order to the capsule charging mechanism 20. In addition, a rotatable brush roller 36 is provided above the supply drum 32 to face the uppermost portion of supply drum 32. The capsule direction regulating mechanism 30 is disclosed in detail as a capsule direction regulating apparatus in, for example, Japanese Laid-Open Patent Publication No. 61-211213 which is an application by the applicant of this invention, and which is well-known in itself, thereby omitting detailed description of concrete operation of the above members and mechanisms. Alternately, the capsule charging apparatus of the invention may invoke any desirable direction regulating system other than the aforesaid one.

Figure 4:
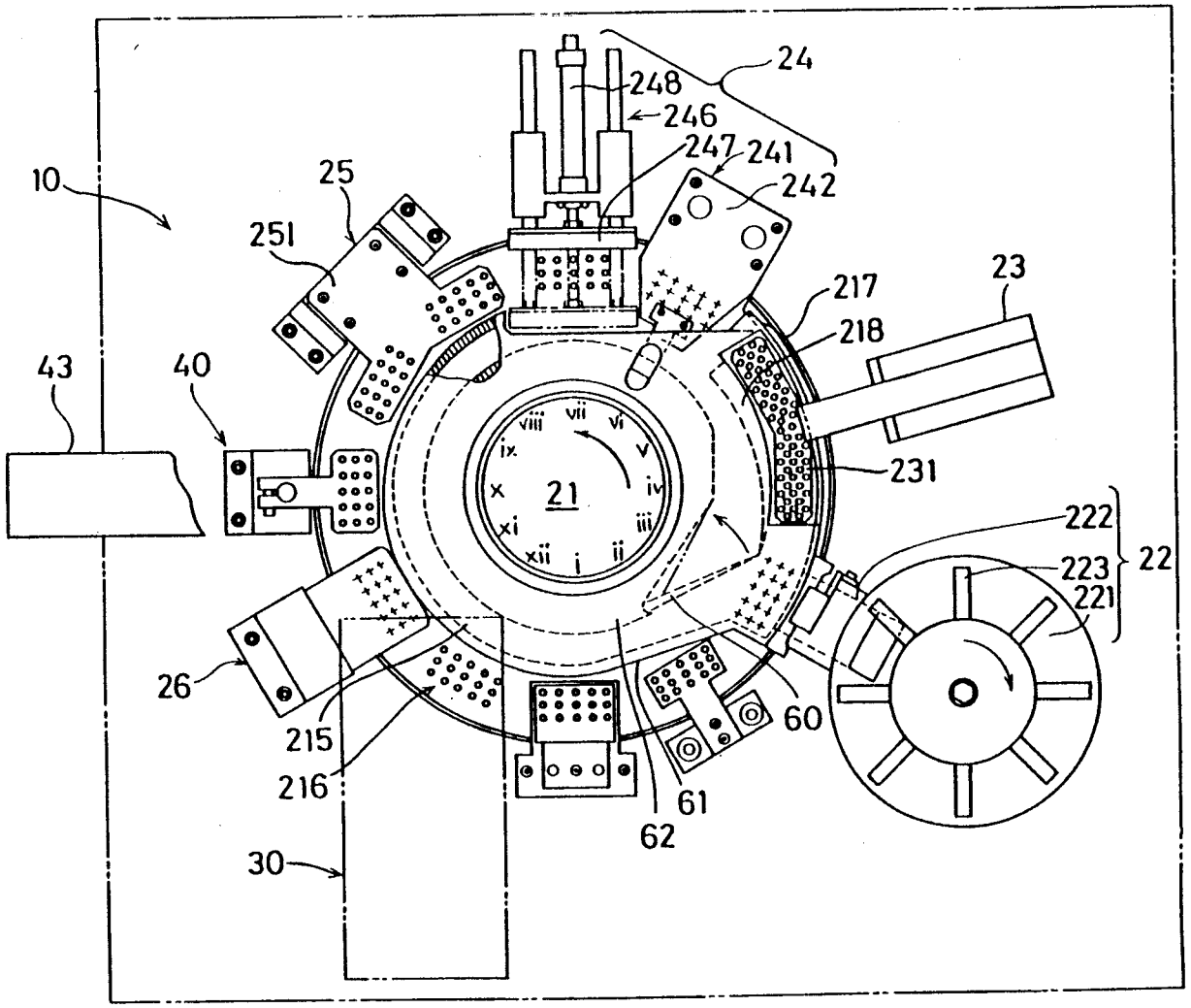
FIG. 4 is a plan view showing the capsule charging apparatus of FIG. 3 in slightly more detail in the state where a cap rotary member is removed therefrom.

The capsule charging mechanism 20, as abovementioned, comprises the turntable 21 which conveys capsules by rotating intermittently in the direction shown by an arrow at each predetermined rotation angle around a vertical shaft 211 (i.e., rotating intermittently so as to pause in each of the positions i to xii shown in FIG. 4), and the capsule transporting mechanism 35 of the capsule direction regulating mechanism 30, a filling supply mechanism 22, a vibration applying mechanism 23 for the filling, a filling quantifying mechanism 24, a capsule coupling mechanism 25 and a cleaning mechanism 26, which are disposed around the turntable 21 and regularly spaced apart from each other at fixed intervals determined by a predetermined rotation angle.

The turntable 21 comprises a pair of rotary members 212 and 215 disposed opposite to each other with a predetermined space therebetween in the vertical direction of vertical shaft 211. The rotary member positioned above the vertical shaft 211 (i.e., a drive shaft) serves as a cap rotary member. On the disc surface of the cap rotary member, a large number of cap containing pockets 213 for holding the caps separated from the bodies are bored regularly in groups consisting of a fixed number of pockets (in the shown embodiment, 12 groups of 15 pockets each: 180 pockets in total). Meanwhile, the rotary member 215 disposed opposite to and below the cap rotary member 212 serves as a body rotary member. On the disc surface of the body rotary member, body containing pockets 216 are regularly provided corresponding to and equal in number to the cap containing pockets 213 of the cap rotary member 212.

Figure 6B:
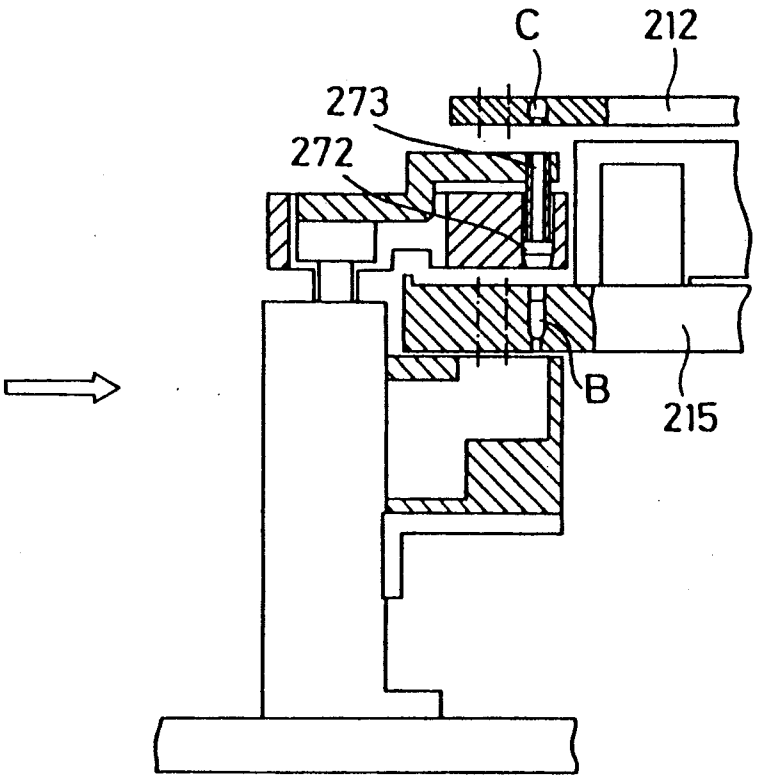
FIGS. 6A and 6B are sectional side views of a part of the capsule charging apparatus showing a separation process of a capsule into a body and a cap.
Figure 6A:
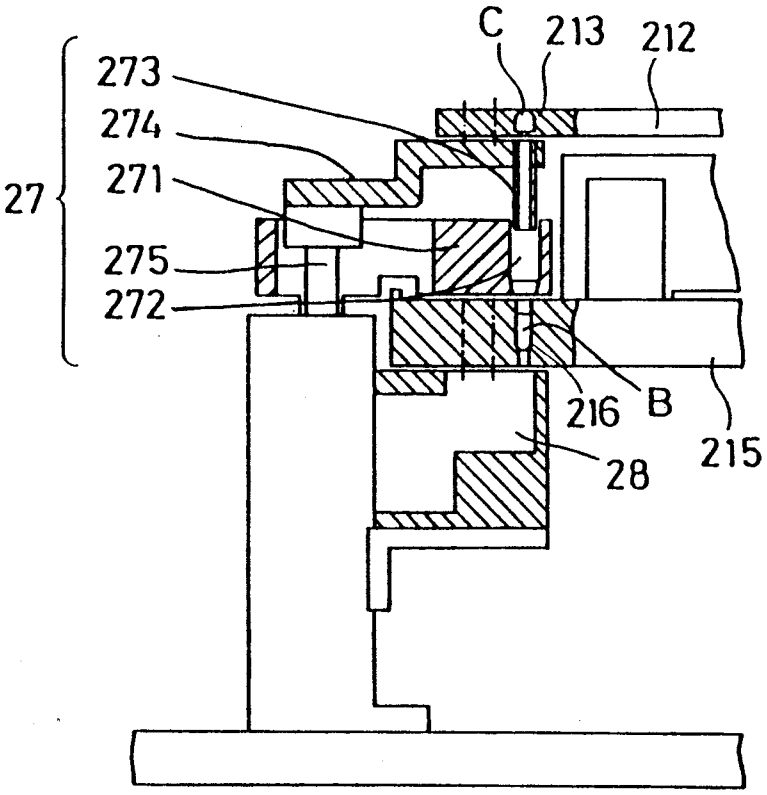

The upright capsules delivered from the capsule transporting mechanism 35 are at first held as they are in the cap containing pockets 213 and then separated bodies from caps in preparation for being charged with the filling. The capsule charging apparatus of this invention has a capsule guide member 27 which is interposed between the cap rotary member 212 and the body rotary member 215 and connects the cap containing pockets 213 to the body containing pockets 216 corresponding thereto respectively when the capsules are separated into caps and bodies. The capsule guide member 27, as shown in FIGS. 6A and 6B, comprises pocket bores 272 bored at a capsule guide base 271 and tubular members 273. As the inner diameter of the pocket bore 272 is larger than the outer diameter of the tubular member 273, the tubular member 273 is inserted at one end thereof into the bore 272 so as to allow the capsule to pass. The tubular members 273 are fixed to a movable panel 274 which can move in vertical direction with respect to the capsule guide base 271 by means of an arm 275.

When the body and cap of each capsule are separated from each other and recoupled with each other after being charged with a filling (in other words, during the stop of intermittent rotation of the rotary members), which will be discussed below, the capsule guide base 271 of the capsule guide member 27, as shown in FIG. 6A, moves close to the upper surface of the body rotary member 215 with a slight gap remaining therebetween, and the movable panel 274 raises close to the lower surface of the cap rotary member 212 by lifting the arm 275 in a relation of nearly contacting with the lower surface of the cap rotary member 212, so that the cap containing pockets 213 and body containing pockets 216 corresponding thereto substantially communicate with each other, thereby forming a passage through which the body separated from the cap falls. Accordingly, in this state, each capsule body separated from the cap is guided by the capsule guide member 27 and completely held in the corresponding body containing pocket 216.

Meanwhile, when the body rotary member 215 and cap rotary member 212 intermittently rotate, as shown in FIG. 6B, the arm 275 of the capsule guide member 27 operates just before the rotation of the rotary members to move the capsule guide base 271 and movable panel 274 fully away from the body rotary member 215 and cap rotary member 212, thereby performing the intermittent rotation of both the rotary members without hindrance.

Figure 3:
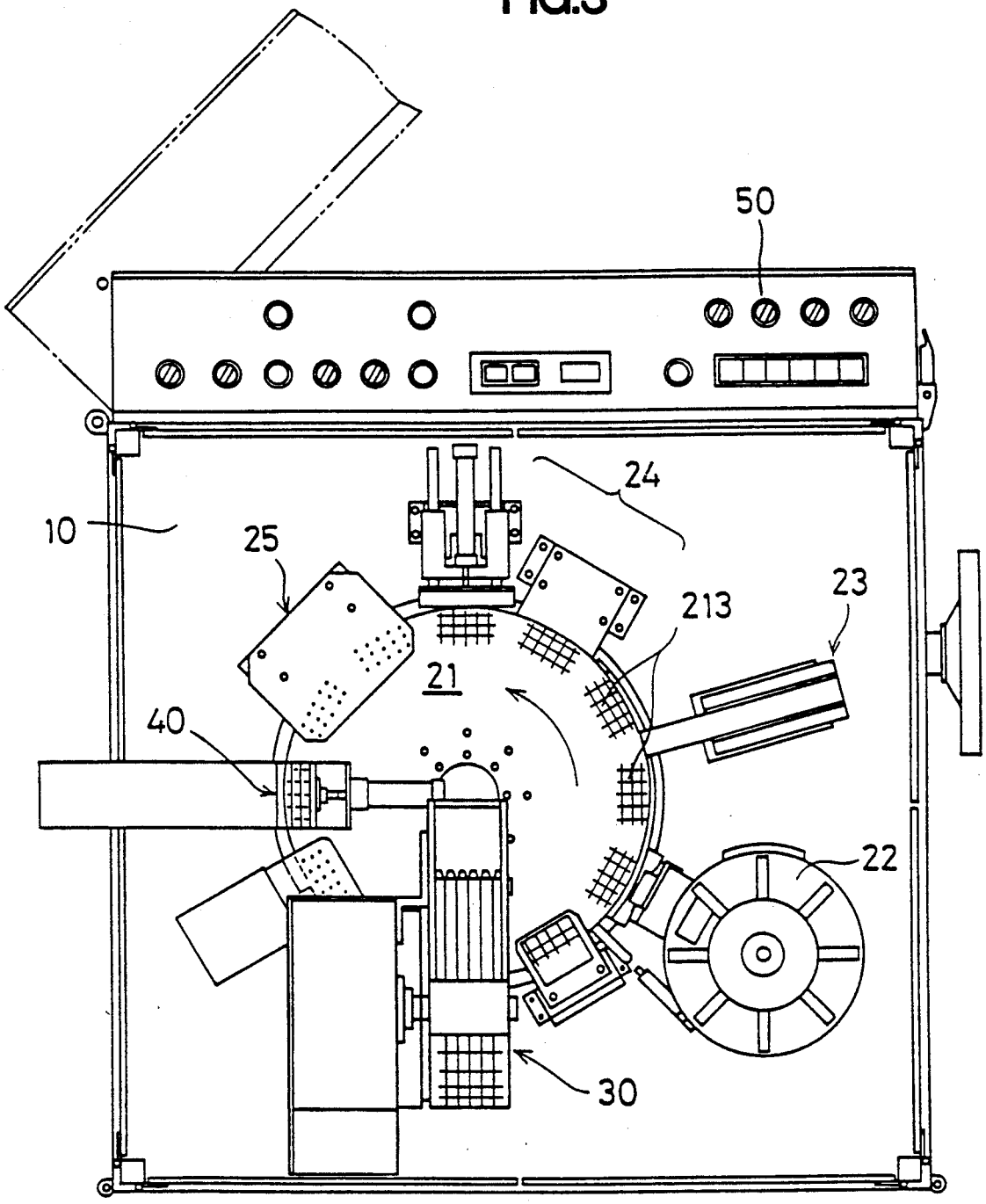
FIG. 3 is a plan view of the capsule charging apparatus of the present invention.

The filling supply mechanism 22, as shown in FIGS. 3 and 4, is provided in the vicinity of the body rotary member 215 and downstream of the capsule transport mechanism 35 in the direction of rotation of the rotary member 215, and comprises a filling hopper 221 and a filling supply damper 222 which communicates at one end with a lower opening of the hopper 221 and is open at the other end into an area of a charging room on the body rotary member 215. In addition, an agitator (vanes) 223 which is equipped in the hopper 221 may be omitted by the property, especially the fluidity, of filling. Although the filling supply mechanism in this embodiment shown by the drawings is for the filling of powder, when the filling is granule or liquid, it must be changed to a different filling supply mechanism for granule or liquid.

The filling, such as powder, supplied from the filling supply mechanism 22 to the charging room area on the body rotary member is subjected to vibrations from a vibrating plate 231 by the vibration applying mechanism 23, thereby ensuring good fluidity. Accordingly, the filling in this state naturally falls (flows down) into the capsule bodies contained at the bottoms of the body containing pockets via each body containing pocket 216 open at the charging room area, thereby being charged in the capsule bodies and body containing pockets. Herein, the charging room area indicates an area on the upper surface of the body rotary member 215 from the position where the filling supply damper of the filling supply mechanism 22 is disposed to the filling quantifying mechanism, and is partitioned by an outer peripheral wall 217 and an inner peripheral wall 218 in the radial direction of the rotary member 215.

The filling quantifying mechanism 24 comprises a compression mechanism 241 for the filling charged in the capsule bodies and body containing pockets 216 and a weighing mechanism 246 for scraping-off surplus fillings staying on the body rotary member 215 along the surface of the body rotary member. The filling compression mechanism 241, as shown in FIGS. 9A, 9B and 9C, is composed of a combination of a depressing plate 242 fixed on and closed to the surface of the body rotary member 215 against one group of body containing pockets, and body pushers 243 for pushing up the capsule bodies through the through bores at the bottom of body containing pockets 216. The weighing mechanism 246, as shown in FIG. 4, is disposed one rotation angle above the filling compression mechanism 241 in the direction of rotation of the body rotary member and has a scraper plate 247 as its main part which reciprocates in the radial direction on the body rotary member along the upper surface thereof. The scraper plate 247, by its reciprocating motion, scrapes off the surplus filling staying on the body rotary member 215 (over the body containing pockets 216), thereby equalizing the amount of filling in each body containing pocket. The amount of filling can be adjusted minutely by controlling the up-and-down stroke of body pushers 243 of the compression mechanism 241.

Figure 10:
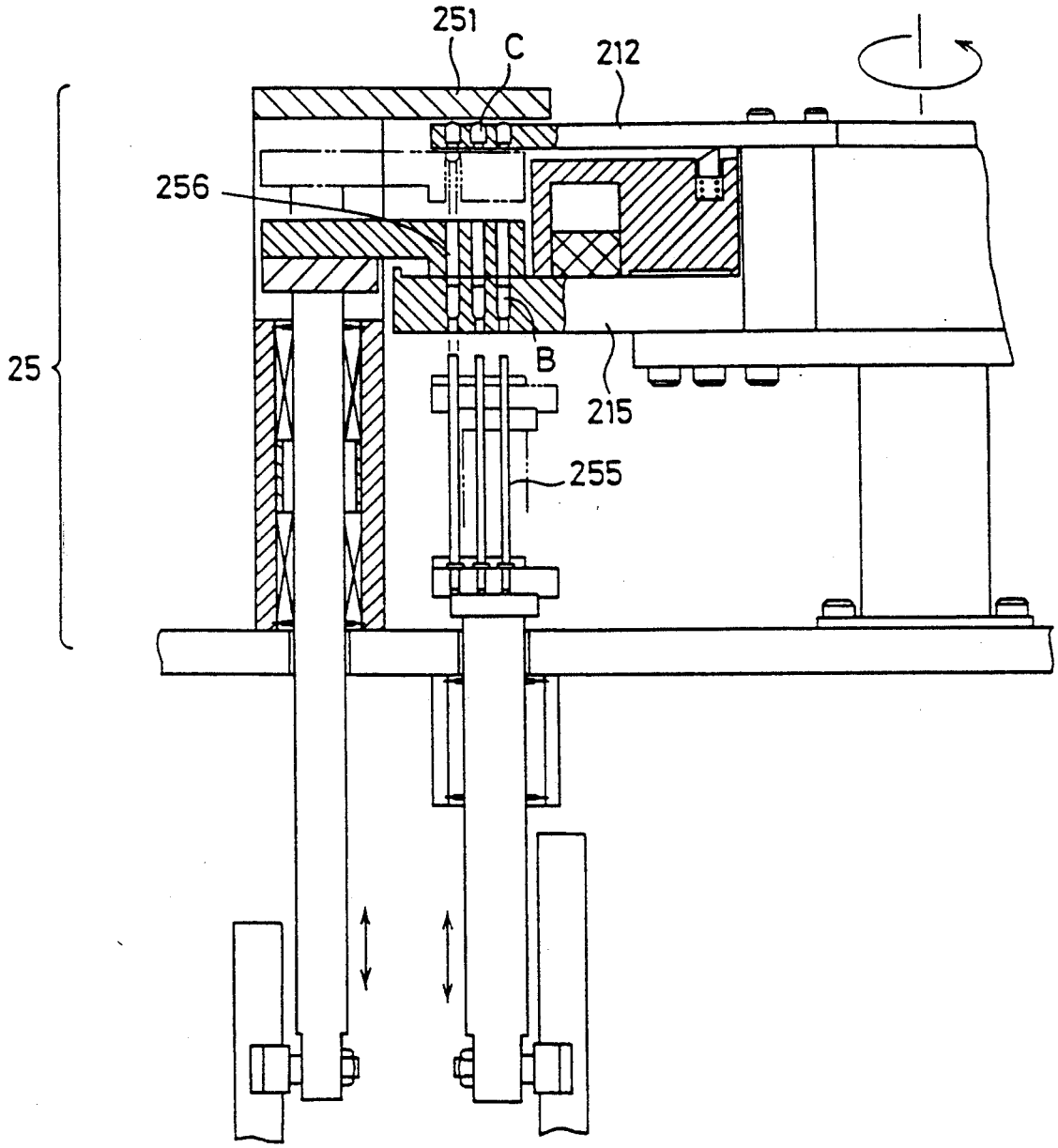
FIG. 10 is a sectional side view showing a recoupling process of the capsule charging apparatus of the present invention.

The capsule coupling mechanism 25 is equipped one rotation angle next to the filling quantifying mechanism 24 in the direction of rotation and, as shown in FIG. 10, comprises a cap depressing plate 251 fixed close to the upper surface of cap rotary member 212, pushers 255 for pushing up the bodies charged with filling toward the cap rotary member 212 through the through bores at the bottoms of body containing pockets 216, and capsule guide members 256 which are movable in the vertical direction for guiding the bodies, when being pushed up, to the cap containing pockets 213 of the cap rotary member from the body containing pockets 216. In other words, each body charged with a filling is pushed up by the pusher 255 into the just above capsule guide member 256 from the body containing pocket 216, raised as it is and together with the guide member 256 to just below the cap rotary member 212, and then is pushed further upwardly by the pusher 255, thereby completing coupling of the body with the corresponding cap in each cap containing pocket 213. The capsule guide member 256 for coupling of bodies and caps is constituted of each tubular member of an inner diameter through which the capsule is allowed to pass as shown. The constitution of the capsule guide member is not limited to this embodiment. In addition, in the embodiment shown in the drawing, a further pair of cap depressing plate 251 and pushers 255 are juxtaposed at the next angle in the direction of rotation and the coupling operation is repeated, so that the pushers operate in association with the coupling motion of the body and cap as abovementioned, thereby further ensuring coupling of them.

Figure 11:
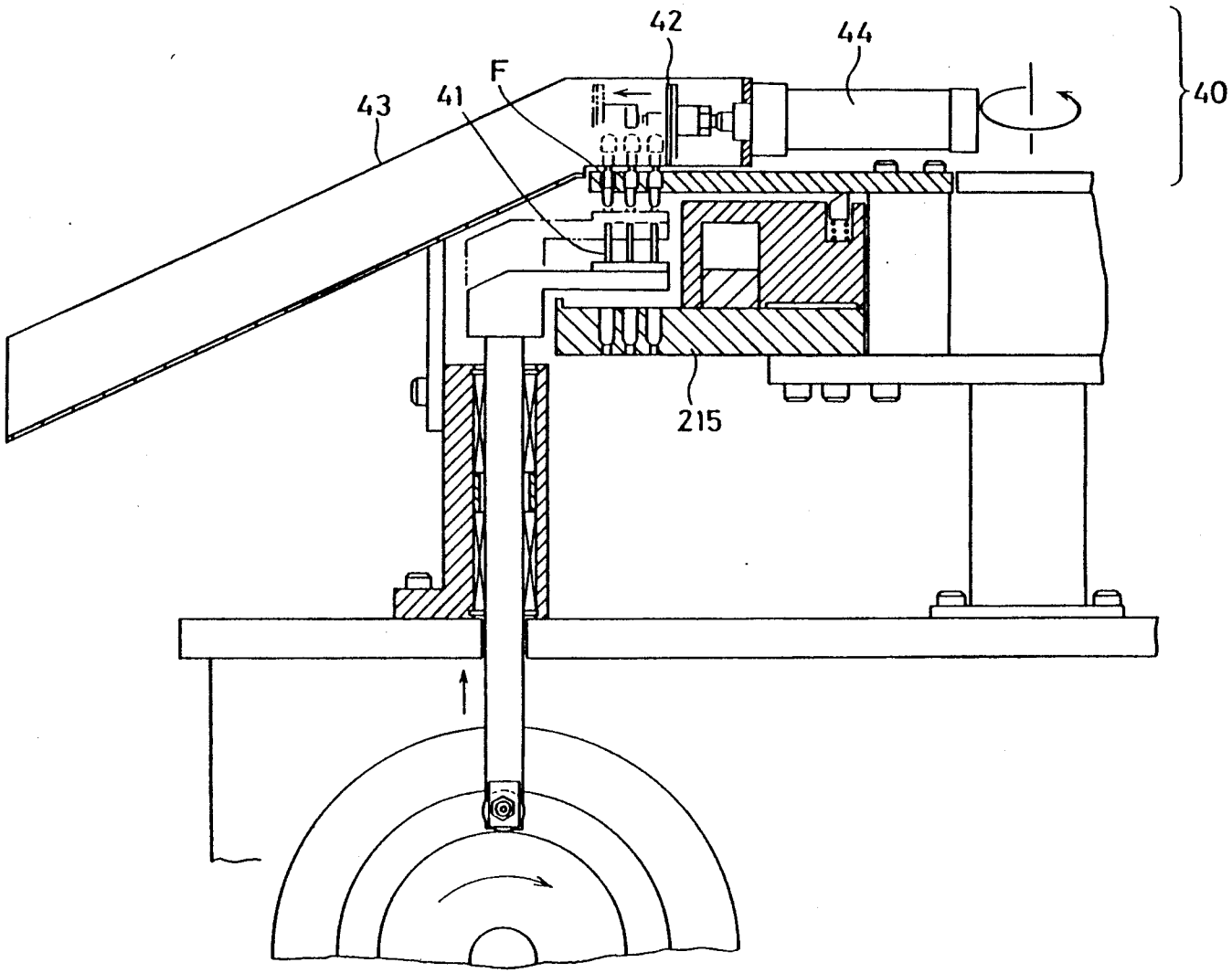
FIG. 11 is a sectional side view showing a process for ejecting charged capsules in the capsule charging apparatus of the present invention.

The capsule charged with filling with its body and cap coupled is taken out from the apparatus by a capsule ejection mechanism 40 at the next rotation angle to the coupling mechanism. As shown in FIG. 11, the capsule at first is pushed up by the pusher 41 onto the cap rotary member 212 and then ejected to a chute 43 out of the system by use of a scraper 42 which moves in a radial direction on the cap rotary member along the upper surface thereof.

The cleaning mechanism 26 is disposed at the next rotation angle to the disposed position of capsule ejection mechanism 40. After the charged capsules are ejected, the cleaning mechanism 26 cleans the surface of the body rotary member and the inside of each body containing pocket, and the surface of the cap rotary member and the inside of each cap containing pocket respectively. The cleaning mechanism is connected to an air compression apparatus and a vacuum suction apparatus (not shown) which are separately equipped.

The body containing pockets 216 and cap containing pockets 213 cleaned by the cleaning mechanism 26 receive at the next rotation angle new empty capsules aligned upright from the capsule transporting mechanism 35 and hold them in preparation for the next stage of charging the filling. Thereafter, the above-mentioned operation processes are continuously repeated so that the charged capsules can be obtained by every revolution of the body rotary member and cap rotary member.

In addition, a filling passage change-over damper 60 in FIG. 4, in cooperation with filling passage guides 61 and 62 fixed close to the upper surface of body rotary member 215, moves in the direction shown by an arrow so as to cut off flow-in of the filling from the filling supply mechanism 22 to the charging room if necessary and to guide the filling to the exterior of the charging room.

Next, explanation will be given on the operation process of each mechanism in accordance with the drawings.

(1) Capsule loading and separation (FIGS. 6A and 6B)

FIGS. 6A and 6B show the loading process of empty capsules and the separation process of the body and cap of each capsule in the apparatus of this invention. In FIG. 6A, separation of the capsule is shown, in which the capsule supplied from the capsule transporting mechanism 35 is separated into the body and cap. The empty capsules at first are received in upright posture with their bodies facing downwards from the capsule transporting mechanism 35 into a plurality (15 per group) of cap containing pockets 213 of the cap rotary member 212 which rotates intermittently and pauses at every predetermined rotation angle, and then each capsule body B separated from the cap passes through the tubular member 273 and pocket bore 272 of the capsule guide member to be received in the corresponding body containing pocket 216 of the body rotary member 215. A capsule separating vacuum chute 28 is provided under the body rotary member 215 so that the capsule sucked by vacuum is separated into the body B and cap C by the stepped portion at the cap containing pocket. The capsule guide member 27 serving as an inductive route of the separated capsule body B to the body containing pocket comprises the pocket bores 272 and tubular members 273 which are fitted movably in the vertical direction. When the cap rotary member 212 and body rotary member 215 rotate, as shown in FIG. 6B, the capsule guide member moves away from both the rotary members 212 and 215, thereby preventing a capsule which is not separated in the separation process or a capsule body which is not completely hold in the body containing pocket from being crushed.

(2) Removal of unseparated and/or inverted capsules (FIG. 7)

Figure 7B:
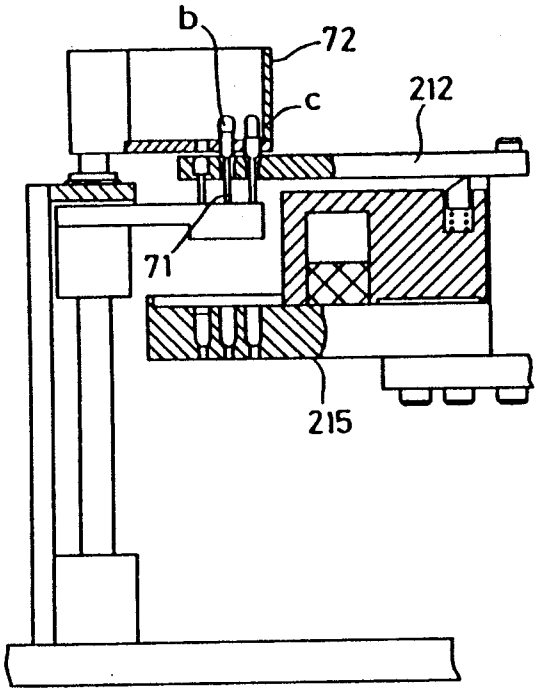
FIGS. 7A and 7B are sectional side views showing an operation process for removing unseparated or inverted capsules in the capsule charging apparatus of the present invention.
Figure 7A:
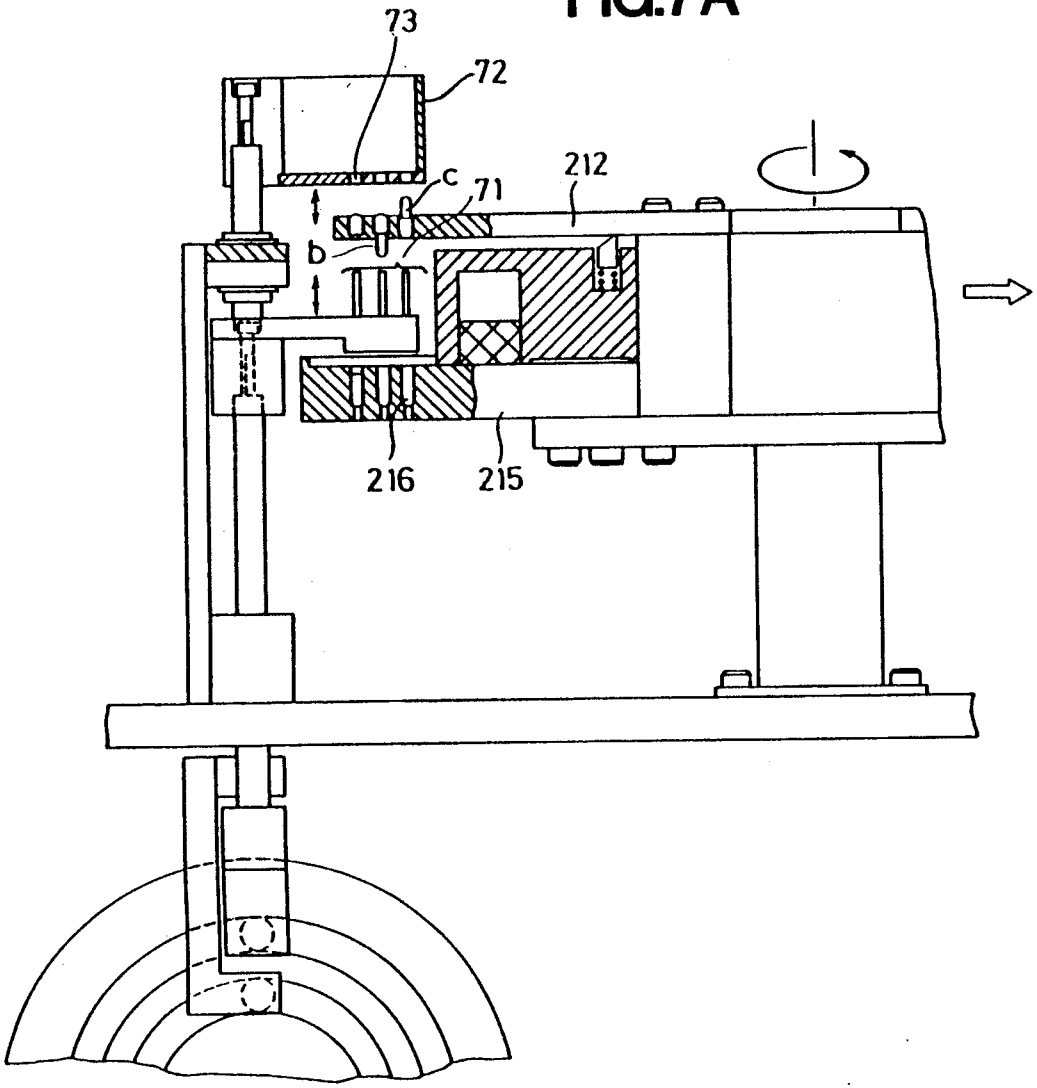

FIG. 7A shows an operation process for removing a capsule which is unseparated or inverted. The capsule b which is not separated into the body and cap and the capsule c which is inverted (i.e., which is not regulated in proper direction), as shown in FIG. 7B, are pushed up by pushers 71 into an upper recovery case 72. Oblong holes 73 which are capable of holding capsules in condition of being pinched are formed at the recovery case 72 corresponding to the cap containing pockets 213. The unseparated capsule b and inverted capsule c are collected in such a manner that the pushers 71 are lifted simultaneously with the falling of the recovery case 72 so as to push up the capsules b and c into the recovery case 72 through the holes 73. The unseparated or inverted capsules contained in the recovery case 72 do not fall out therefrom because the shorter diameter of the oblong hole 73 is slightly smaller than the outer diameter of the capsule.

Figure 8:
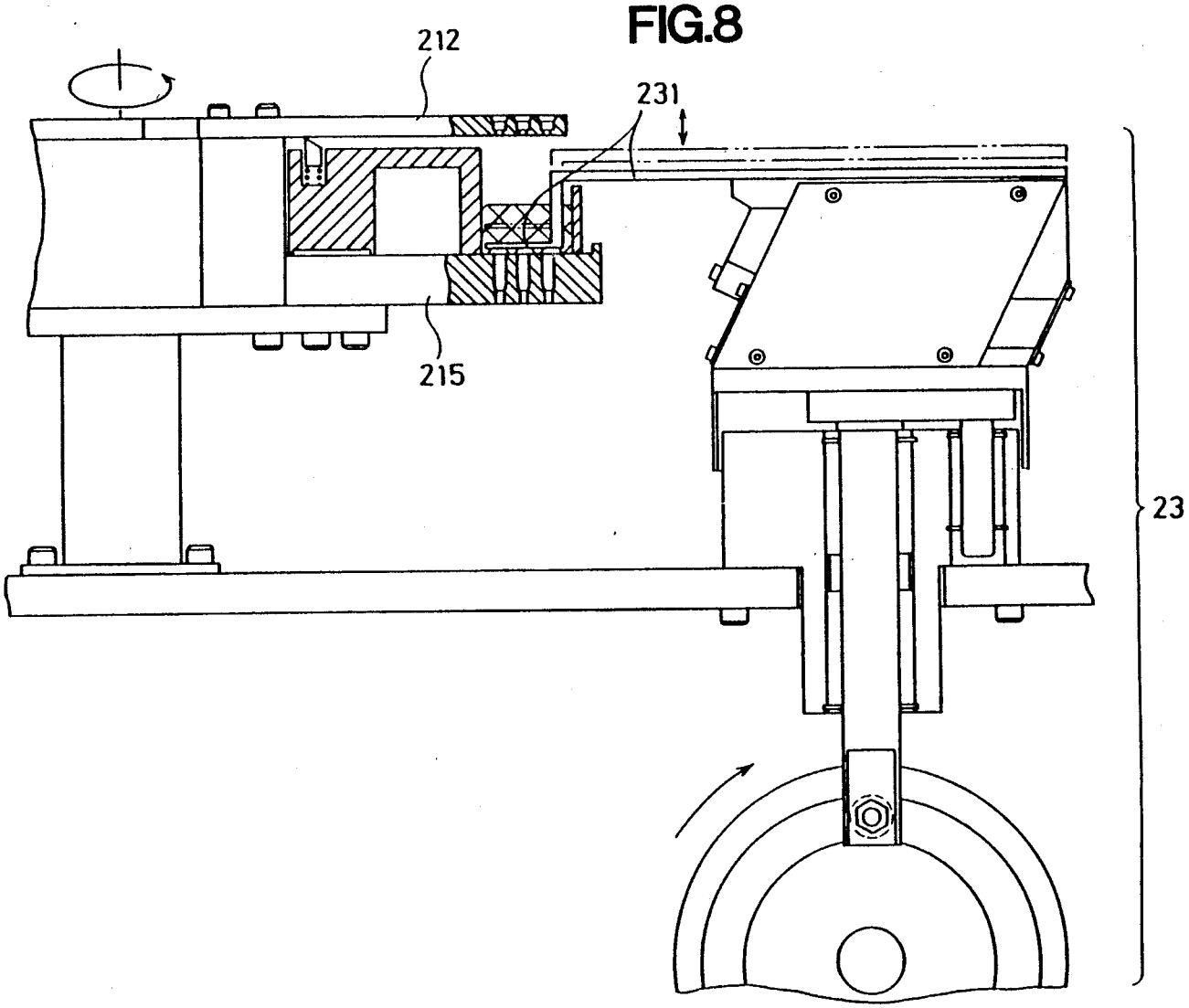
FIG. 8 is a sectional side view showing an operation process for charging capsules with filling in the capsule charging apparatus of the present invention.

(3) Charging (FIGS. 8 and 9)

a. Powder charging

FIGS. 8 and 9 are schematic views showing the charging operation, in which a powder charging mechanism is exemplified. The present invention may of course apply desirable well-known charging mechanisms for granule or liquid other than the above.

A layer of a filling (powder) is provided over the body containing pockets 216 of the body rotary member 215, the vibrating plate 231 improves the fluidity of filling, and the filling is charged by natural flow into the capsule bodies in the body containing pockets.

b. Compression

FIGS. 9A to 9C are schematic views showing the compression mechanism 241 for the filling at the filling quantifying mechanism 24. As shown in FIGS. 9A and 9B, the depressing plate 242 is provided above the body rotary member 215 to close the open end of each body containing pocket 216. Next, as shown in FIG. 9C, the body pushers 243 push up the closed ends of capsule bodies by springs 244, thereby moderately compressing the filling in the body B. The springs 244 keep biasing forces of the body pushers about uniform, thereby reducing variation in weight of filling as much as possible.

c. Filling weighing (FIGS. 4 and 5)

A filling to be charged in the capsule body is quantitatively weighed prior to be coupled with the cap by the filling weighing mechanism 246 shown in FIGS. 4 and 5. The bodies in the body containing pockets 216 of the body rotary member 215 are pushed up by the pushers and surplus filling coming out from the upper surface of body rotary member is scraped off by the scraper plate 247. The surplus filling scraped-off is moved in the radial direction toward the center of the body rotary member 215 and removed through the charging room area, the scraper plate 247 being operated with the timing by an air cylinder 248 provided laterally thereof.

(4) Coupling (FIG. 10)

FIG. 10 shows an operation process of recoupling the cap with the body charged with a filling. In this process, the bodies B are pushed up by the pushers 255 to couple with the corresponding caps C at the cap rotary member. The bodies B pushed out from the body containing pockets 216 are received into the capsule guide members 256 positioned just above the bodies B and raised together with the capsule guide members 256 directly to the lower surface of the cap rotary member 212, and thereafter only the bodies B are pushed further upwardly by the pushers 255 to be coupled with the caps C respectively. In this case, since the depressing plate 251 restrains the caps C from upward movement, only the push-up force of pushers 255 completely couples the bodies with the caps respectively.

(5) Ejection (FIG. 11)

FIG. 11 is a schematic view showing takeout of the capsule F having been charged with the filling. In this process, the charged capsules F are pushed up by the pushers 41 above the cap rotary member 212 and then pushed into the chute 43 by the scraper 42 attached to the air cylinder 44, thereby being sequentially housed into a desired container.

(6) Cleaning

This operation process is performed at the next rotation angle to the capsule ejection mechanism 40. The filling, dust, or the like, attached to the cap rotary member 212 and cap containing pockets 213 and the body rotary member 215 and body containing pockets 216, after the charged capsules have been completely taken out, are removed and cleaned by compressed air and vacuum suction, thereby contributing to maintain smooth operation of the apparatus of the invention.

Figure 12:
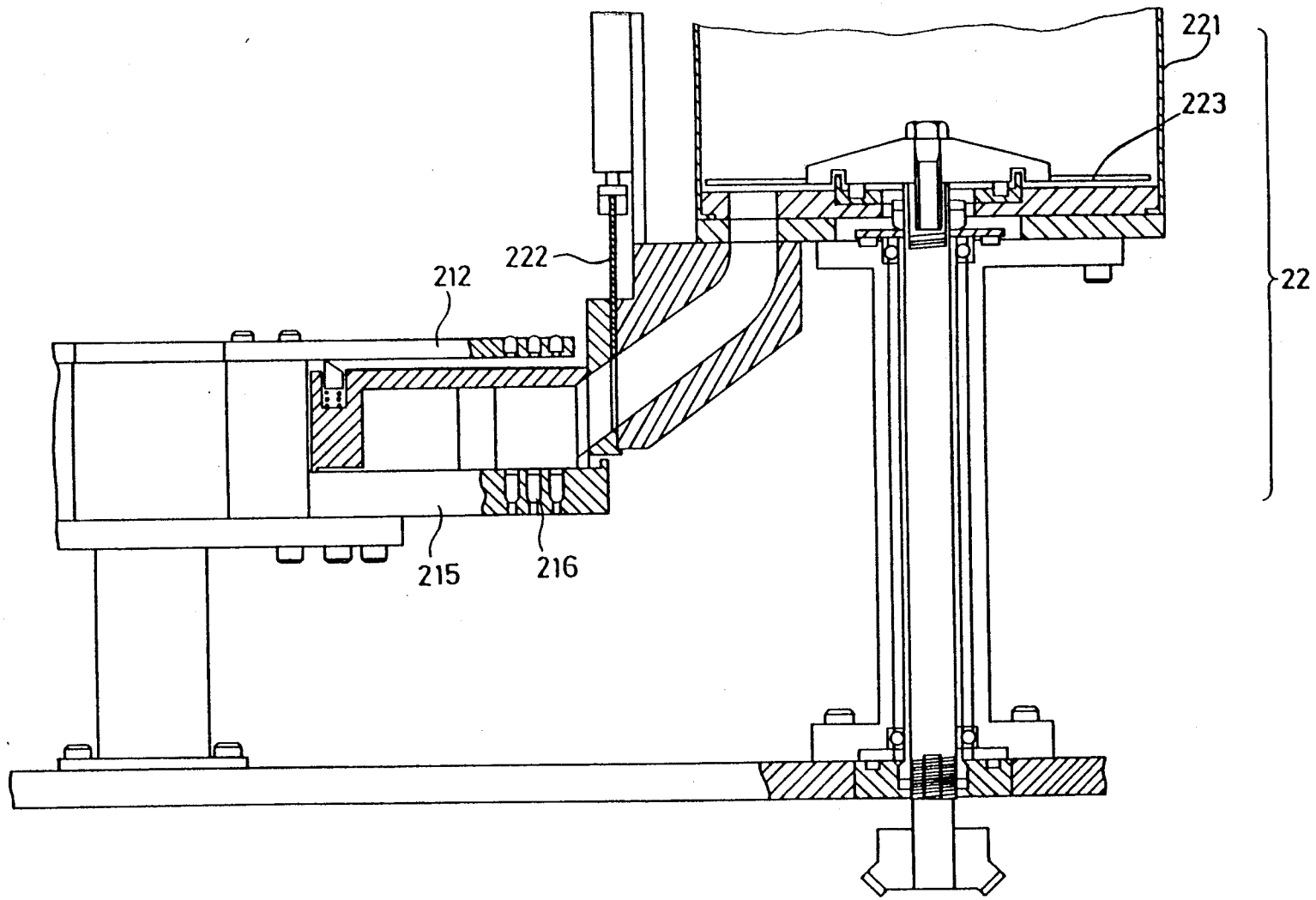
FIG. 12 is a sectional side view showing a filling supply mechanism of the capsule charging apparatus of the present invention.

(7) Supply of a filling (FIG. 12)

FIG. 12 shows the filling supply mechanism for powder, in which the filling charged into the 10 hopper 221 is supplied by the filling supply damper 222 into the charging room area over the body rotary member 215. The filling supply damper 222 is actuated by the air cylinder for driving the supply damper by receiving a signal from a level detector individually provided, thereby being adapted to keep about constant the filling level on the body rotary member.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. In a capsule charging apparatus for charging a hard gelatin capsule with a filling of powder, granule, or liquid continuously in constant amounts, wherein said capsule having a cap and a body coupled together is received and held in an upright posture at one of the positions in which a turntable intermittently rotatable through every predetermined rotation angle around a vertical shaft pauses, and operation processes such as separation of said filling into said body of said capsule, charging of said filling into said body, coupling of said cap with said body, and ejection of said charged capsule are performed in order during one rotation of said turntable at plural positions including said position which are defined by said rotation angle of said turntable, said capsule charging apparatus is characterized in that said turntable comprises a cap rotary member and a body rotary member disposed opposite to each other with a predetermined space therebetween in the vertical direction of said vertical shaft of said turntable and on the disc surface of said cap rotary member, cap containing pockets for holding the caps separated from the bodies are provided, and on the disc surface of the body rotary member, body containing pockets are provided corresponding to said cap containing pockets of said cap rotary member, between said cap rotary member and said body rotary member a capsule guide member is interposed for separating said capsule which connects the cap containing pockets with corresponding body containing pockets so as to allow said capsule body to pass from said cap containing pockets to said body containing pockets only when said capsule is separated into cap and body, and between said cap rotary member and said body rotary member a capsule guide member is interposed for coupling said capsule which connects the cap containing pockets with corresponding body containing pockets so as to allow said capsule body to pass from said body containing pockets to said cap containing pockets only when said cap is coupled with said body charged with a filling, wherein, said capsule guide member for separating said capsule comprises pocket bores bored at a capsule guide base and tubular members inserted one end thereof movably in the vertical direction into said pocket bores with large diameter allowing said capsule body to pass therethrough, and said capsule guide member for coupling said capsule comprises tubular members provided movably in the vertical direction allowing said capsule to pass therethrough.

2. A capsule charging apparatus according to claim 1, wherein said capsules are substantially simultaneously processed in groups consisting of a plural number of capsules in a series of said operation processes.

3. A capsule charging apparatus according to claim 1, wherein said capsule body is charged by natural fall of said filling.

* * * * *